United States Patent [19]

Conforti et al.

[11] 4,138,664

[45] Feb. 6, 1979

[54] WARNING DEVICE

[75] Inventors: Frederick J. Conforti, Aurora; Richard J. Schwarzbach, Naperville; Quentin L. Schneider, Bensenville, all of Ill.

[73] Assignee: Pittway Corporation, Northbrook, Ill.

[21] Appl. No.: 751,021

[22] Filed: Dec. 14, 1976

[51] Int. Cl.[2] ..... G08B 17/10

[52] U.S. Cl. ..... 340/507; 250/381; 340/629; 340/636; 340/693

[58] Field of Search ..... 340/237.5; 250/381; 302/304, 362; 330/35

[56] References Cited

U.S. PATENT DOCUMENTS

| | | | |
|---|---|---|---|
| 2,795,904 | 3/1974 | Beyersdorf et al. | 340/237.5 |
| 3,500,368 | 3/1970 | Abe | 340/237.5 |
| 3,594,751 | 7/1971 | Ogden et al. | 340/237.5 |
| 3,798,625 | 3/1974 | McMillian et al. | 340/237.5 |
| 3,944,859 | 3/1976 | Hoover | 340/237.5 X |
| 3,956,643 | 5/1976 | Hite | 302/304 X |

*Primary Examiner*—Donald J. Yusko
*Assistant Examiner*—Daniel Myer
*Attorney, Agent, or Firm*—Gary, Juettner & Pyle

[57] ABSTRACT

An improved warning device having a sensor responsive to predetermined phenomena to generate a signal which changes in value upon the presence of the phenomena, and means for comparing the signal with a reference potential and for generating an indication upon a predetermined difference therebetween, is characterized by integrated circuit components which may economically be manufactured and assembled, and which maintain substantially constant the sensitivity of the device to the phenomena despite changes in the level of power supplied thereto. Where the warning device is a battery powered fire detector, the phenomena to be sensed is products of combustion, circuitry supervises the power level of the battery, and means are provided for readily testing the entire combustion detecting and indication generating portion of the detector, whereby a user of the detector may be assured of proper operation of the detector in response to combustion. The power supplied to the detector by the battery is unregulated, yet the sensitivity of the detector to combustion remains essentially constant despite a decreasing battery voltage with depletion thereof.

12 Claims, 1 Drawing Figure

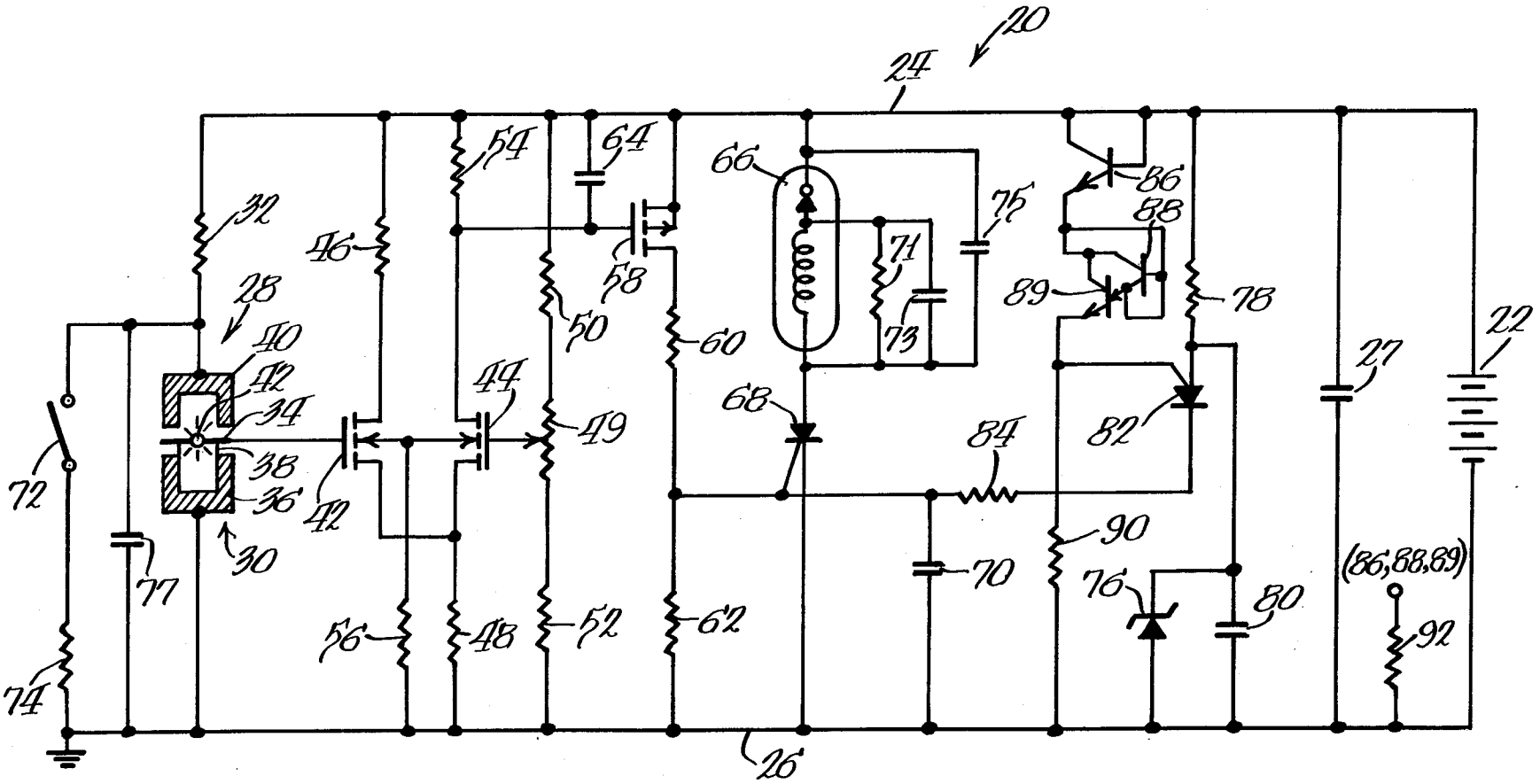
20
22
24
26
27
28
30
32
34
36
38
40
42
44
46
48
50
52
54
56
58
60
62
64
66
68
70
71
72
73
74
75
76
77
78
80
82
84
86
88
89
90
92
(86,88,89)

WARNING DEVICE

BACKGROUND OF THE INVENTION

The present invention relates to warning devices, and in particular to a fire detector of the early warning type having integrated circuit components which may economically be manufactured and assembled, and which maintain the sensitivity of the detector to products of combustion substantially constant despite changes in the level of power supplied thereto.

Fire detectors, particularly those of the ionization chamber type, are often used in home and industry to sense the occurrence of combustion. Such devices detect combustion while it is in its incipient stage, and provide a warning well before the combustion reaches an advanced stage. Obviously, these devices are extremely advantageous in protecting life and property from the danger of fire.

The cost of early fire detectors was such that generally only industry could afford the protection they offered. Recent manufacturing techniques, however, using discrete semiconductor devices in the detector circuits, have reduced the cost of detectors to a level where they are now within the purchasing power of a large number of households. Despite such reduction in cost there are, nevertheless, a significant number of households that still cannot afford a fire detector. It is therefore extremely desirable to further reduce the cost of such detectors, without reducing the sensitivity or reliability thereof, to bring the protection they offer within the economic reach of almost all households.

OBJECTS OF THE INVENTION

An object of the present invention is to provide a fire detector of economical and reliable construction.

Another object of the present invention is to provide such a detector, the circuitry of which is comprised of integrated circuit components.

A further object of the invention is to provide such a detector which is battery powered, has integrated circuitry for supervising the power level of the battery, and manually operable test means for allowing a user of the detector to conveniently and reliably check the operation of the entire combustion sensing and alarm generating portions of the detector.

Still another object of the present invention is to provide such a detector wherein the power supplied thereto is unregulated, yet wherein the sensitivity of the detector remains substantially constant with changes in the level of the power.

SUMMARY OF THE INVENTION

In accordance with the present invention, a warning device includes sensor means for detecting the occurrence of predetermined phenomena, and integrated circuit means, formed on a single substrate, responsive to the sensor means for generating an indication upon the occurrence of the phenomena.

In a disclosed embodiment of the invention the warning device is a battery powered fire detector, and the sensor means is an ionization chamber in series with a reference impedance to form a voltage divider circuit across which a voltage is applied. The integrated circuit means responsive to the sensor includes a pair of field-effect transistors (FETs) connected as a differential amplifier to compare the voltage at the junction of the chamber and the reference impedance with a reference voltage. A third FET is connected with both the differential amplifier and a silicon controlled rectifier (SCR) in series with an alarm device, and is responsive to the differential amplifier, upon the ionization chamber sensing products of combustion, to trigger the SCR to operate the alarm. Integrated circuit means formed on a single substrate supervises the power of the battery, and triggers the SCR to operate the alarm upon the power falling below a predetermined level, the alarm generated in response to low battery power being sensually discernable from that generated in response to combustion. Manually operable means is connected with the chamber and reference impedence to change the voltage thereacross sufficiently to change the voltage at the junction thereof to a value as would occur upon combustion, whereby the entire combustion sensing and alarm generating portion of the detector may be tested.

Preferably, the circuit responsive to the sensor for generating the alarm, and the circuit for supervising the power level of the battery, are formed on the same integrated circuit substrate or chip. As a consequence, economies are introduced into the manufacture of the circuits and the detector, and the individual circuit components are matched (e.g. equally temperature compensated, etc.) for optimum detector reliability. Further, both the voltage across the chamber and reference impedance, and therefore the junction voltage, and the reference voltage, vary directly in accordance with changes in battery voltage, and as a consequence of the use of a differential amplifier to compare the two voltages the sensitivity of the detector to combustion remains substantially constant despite changes in battery output voltage. Also, because of the battery supervision circuit and the manually operable test means, a user of the detector is warned of possible detector failure due to low battery power, and may conveniently and reliably test the detector to be assured of its operation in the event of combustion.

The foregoing and other objects, advantages and features of the invention will become apparent from a consideration of the following detailed description, when taken in conjunction with the appended drawing.

BRIEF DESCRIPTION OF THE DRAWING

The single drawing is a schematic illustration of a warning device having integrated circuits in accordance with an embodiment of the invention, providing both means for generating an alarm upon the occurrence of predetermined phenomena and means for supervising a battery power source for the device.

DETAILED DESCRIPTION

Referring to the drawing, there is shown a warning device or detector, indicated generally at 20, for detecting the occurrence of predetermined phenomena and for generating an indication upon the presence thereof. The detector has a battery 22 providing a power source therefor, and includes means for supervising the power level of the battery, and means for testing the operability of the entire phenomena sensing and alarm generating portion thereof. Integrated circuits provide increased reliability and decreased cost of the detector.

More particularly, the battery 22 is connected to apply an unregulated voltage across a pair of conductor means 24 and 26, with a capacitor 27 smoothing changes in voltage thereacross. Where the detector is a fire detector, the phenomena to be sensed is combustion, and the combustion sensing portion of the detector includes a sensor, shown as an active ionization chamber 28, in series with a reference impedance, shown as a reference ionization chamber 30, both chambers being connected in series with a resistor 32 between the conductor means 24 and 26. The reference chamber includes conductive electrodes 34 and 36 which are maintained in a spaced relationship by a spacer 38 of insulating material, the electrodes and the spacer together former a relatively imperforate closure. The active chamber includes a relatively perforate conductive housing 40 forming one electrode thereof in a spaced relationship with the electrode 34, the electrode 34 forming the other electrode of the chamber and being common to both the active and the reference chambers. Means are provided, such as a radioactive source 42 positioned within a passage through the electrode 34, for ionizing air molecules within both of the chambers, whereby with a voltage applied across the electrodes 36 and 40 an electric field is generated within each chamber to establish a current flow therethrough by movement of the ions between the electrodes. The active and the reference chambers thus form a voltage divider circuit, the impedance of each chamber is at least several magnitudes greater than the impedance of the resistor 32, and therefore the voltage at the electrode 34 at the juncture between the chambers is essentially in accordance with the relative impedances of the chambers. In the alternative, the active and the reference chambers may be physically separate ionization chambers connected in series without a common electrode therebetween, in such case the juncture between the chambers exhibiting the voltage in accordance with the relative impedances of the chambers.

Changes in ambient conditions affect the ion current flow through the chambers, and therefore the impedances thereof. Natural changes in ambient conditions, such as changes in barometric pressure, temperature and relative humidity, occur slowly, and for such changes the relatively closed reference chamber responds (changes its impedance) substantially simultaneously and in proportion with the active chamber, and the voltage at the electrode 34 remains essentially constant. The reference chamber thus compensates the voltage divider circuit for slow changes in ambient conditions. For relatively rapid changes in ambient conditions, as occur with combustion, products of combustion concentrate in the relatively open active chamber much more rapidly than in the reference chamber. The products of combustion have a greater mass than air molecules, and upon entry into the active chamber they combine with the ionized air molecules therein to effectively reduce the current flow in accordance with their concentrations. The reduced current flow increases the impedance of the chamber and, for the circuit connections shown, causes a decrease in the voltage at the common electrode 34. A predetermined change in the voltage at the electrode 34 may, then, be used as an indication of the occurrence of combustion.

In accordance with the invention, means for monitoring the voltage at the electrode 34 and for generating an indication upon a predetermined change in the value thereof includes integrated circuitry which is economically formed on a single chip or substrate. By virtue of the circuit being formed on a single chip the components thereof are matched (e.g. equally temperature compensated, etc.) for increased detector reliability, and the circuit is readily and economically integrated into the detector.

The integrated circuit includes a pair of field-effect transistors (FETs) 42 and 44 connected as a differential amplifier. The gate of the FET 42 is connected with the electrode 34 for monitoring the voltage thereat, and the drain-source circuit of the FET is connected in series with a pair of resistors 46 and 48 between the conductor means 24 and 26. The gate of the FET 44 is connected with the slider of a potentiometer 49 in series with a pair of resistors 50 and 52 between the conductor means, and the drain-source circuit of the FET is connected in series with a resistor 54 and the resistor 48 between the conductor means. A resistor 56 connects the conductor means 26, shown as circuit ground, with the substrate reference of the FETs 42 and 44 to protect the FETs against damage in the event the polarity of the battery is reversed.

With the FET 42 connected to monitor the voltage at the electrode 34, the setting of the potentiometer establishes a reference potential for the differential amplifier. For a given setting, the conductivity of the FET 44, and therefore the current flow therethrough and the voltage across the resistor 54, is determined by the voltage at the electrode 34, with a decrease in the value of the electrode voltage causing a decrease in the conductivity of the FET 42 and an increase in the conductivity of the FET 44, and therefore an increase in the voltage across the resistor 54. A FET 58 is connected at its gate with the resistor 54 for sensing the voltage thereacross, and with its drain-source circuit in series with a pair of resistors 60 and 62 between the conductor means. A capacitor 64 smooths changes in the voltage at the gate of the FET, and a decrease in the voltage at the electrode 34 results in an increase in the conductivity of the FET.

An indication or alarm generating means includes an audible alarm, shown as a horn 66, connected in series with a silicon controlled rectifier (SCR) 68 between the conductor means. The gate of the SCR is connected to sense the voltage at the junction between the resistors 60 and 62 for having the SCR triggered into conduction thereby, and a capacitor 70 is connected between the gate of the SCR and the conductor means 26 to inhibit false triggering of the SCR. Upon conduction of the SCR the horn is connected across the battery to sound an alarm, with a resistor 71 and a pair of capacitors 73 and 75 then providing suppression for the horn.

Under ambient conditions in the absence of products of combustion the electrode 34 is substantially at a first potential, and the potentiometer 49 is adjusted to control the current flow through the FET 44, and therefore the voltage drop across the resistor 54 and the current flow through the FET 58, so that the voltage at the junction of the resistors 60 and 62 is less than sufficient to trigger the SCR into conduction, whereby the horn is not sounded. Upon the occurrence of products of combustion in predetermined minimum concentrations, the relatively rapid increase in impedance of the active chamber 28, with respect to that of the reference chamber 30, causes a predetermined change or a decrease in the potential at the electrode 34 to at least a second potential. This decreases the conductivity of the FET 42, increases the conductivity of the FETs 44 and 58, and increases the voltage at the juncture of the resistors 60 and 62 sufficiently to trigger the SCR into conduction to connect the horn across the battery to sound an alarm. The alarm continues until the active chamber is cleared of products of combustion to decrease the voltage at the resistor junction below the SCR trigger voltage, whereupon the SCR becomes nonconductive upon the next opening of the horn contacts.

It is to be noted that, unlike with prior detectors, the circuit of the invention advantageously provides for use of an unregulated voltage across the ionization chamber bridge. The active and the reference chambers have a predetermined impedance relationship under normal atmospheric conditions, and the impedance of each chamber is on the order of several magntiudes greater than the impedance of the resistor 32. Thus the potential at the electrode 34, and therefore at the gate of the FET 42, changes in proportion to changes in battery voltage. Similarly, the voltage at the gate of the FET 44 changes in proportion to battery voltage. As a consequence, the balance of the differential amplifier formed by the FETs 42 and 44, and therefore the sensitivity of the detector, is not affected by changes in battery voltage, and voltage regulation across the conductor means is not required.

Means for completely and reliably testing the combustion sensing portion of the detector, to ensure proper operation thereof in the event of combustion, includes a manually operable test switch 72 connected in series with a resistor 74 between the active chamber electrode 40 and the reference chamber electrode 36. The resistance of the chambers is several magnitudes greater than the impedance of the resistor 74, so that upon closure of the switch the resistors 32 and 74 are connected as a voltage divider, and the voltage across the chambers is made equal to the voltage across the resistor 74. A capacitor 77 smooths changes in voltage across the chambers, and the resistors 32 and 74 are selected to have values to decrease the voltage across the chambers by an amount which is sufficient to change the potential at the electrode 34 to at least the second potential, whereby conduction of the FET 42 decreases and conduction of the FETs 44 and 58 increase to trigger the SCR to energize the horn. Thus, operation of the test switch provides a change in the voltage at the electrode 34 as would occur upon combustion, and operates the entire combustion sensing and alarm generating portion of the detector to sound an alarm. As compared with prior detectors having test switches which ordinarily operate only the audible alarm of the detector to test the alarm and sufficiently of the power supplied thereto, the switch 72 allows a user of the detector to conveniently, quickly and reliably test all components of the detector, a significant safety advantage.

Particular advantages in the initial adjustment of the sensitivity of the detector are obtained if the values of the resistors 32 and 74 are selected to provide at the electrode 34, upon operation of the switch 72, a voltage exactly equal to that which would occur if products of combustion were in the active chamber in the minimum concentrations whereat it is desired to generate an alarm. With the resistors so selected, and with the switch held closed, the potentiometer 48 is set to the point where the SCR 68 is just triggered into conduction, whereupon the sensitivity of the detector circuit is properly adjusted.

To warn a user of the detector of a decrease in available power in the battery 22 to a level requiring replacement thereof, the detector includes integrated circuit means for supervising the energy level of the battery and for providing a warning when the level decreases to a predetermined value. The voltage across the battery decreases as the reserve energy thereof decreases, and the battery supervision circuit monitors the voltage and energizes the horn 66 to provide the warning when the voltage drops to a predetermined value. As compared with the warning provided upon the occurrence of combustion, which comprises a continuous sounding of the horn, the warning for low battery voltage comprises intermittent sounding of the horn, with the periods during which the horn is sounded being significantly shorter than the periods during which the horn is silent. As a result the two warnings are quite sensually discernable, and a user of the detector is readily appraised whether the warning indicates combustion or replacement of the battery. Further, as the warning for low battery power is intermittent, the battery is not rapidly depleted, and continues to provide the warning for a considerable period of time.

The integrated circuit means for supervising the power of the battery includes a zener diode 76 in series with a resistor 78 between the conductor means, and a capacitor 80 connected in parallel with the zener diode. A programmed unijunction transistor (PUT) 82 is connected at its anode to the juncture between the resistor and the zener diode, and at its cathode through a resistor 84 and the resistor 62 to the conductor means 26. Three transistors 86, 88 and 89 are connected as diodes to develop a constant value voltage drop thereacross, and are in series with a resistor 90 between the conductor means, and the gate of the PUT is connected to sense the voltage across the resistor 90. A resistor 92 is connected between the conductor means 26 and the substrate reference (not shown) of the transistors to protect the transistors in the event of reversal of the polarity of the battery.

The zener diode 76 develops a reference potential at the anode of the PUT, and the capacitor 80 is charged to this potential. The voltage developed across the resistor 90 is representative of the battery voltage, and is equal to the battery voltage less the constant value voltage drop across the transistors 86, 88 and 89. The PUT thus compares the voltage representative of the battery voltage at its gate with the reference potential at its anode, and when the gate potential falls to approximately 0.6 volts below the reference potential at the anode, indicative of a predetermined decrease in reserve battery power, the PUT becomes conductive. Conduction of the PUT discharges the capacitor 80 therethrough and increases the voltage across the resistor 62 sufficiently to trigger the SCR into conduction, whereby the horn is sounded. When the capacitor discharges to the point where the current supplied thereby falls below the anode valley current of the PUT, the PUT stops conducting and removes the trigger voltage from the SCR to silence the horn. The capacitor 80 then slowly charges through the resistor 78 until the voltage at the anode of the PUT is again approximately 0.6 volts above the voltage at the gate thereof, and the above described cycle is repeated. The relative values of the battery voltage supervision components are such that the intervals during which the horn is silent are substantially longer than the intervals during which the horn is sounded, whereby battery power is conserved and the low battery voltage warning is generated for a considerable period of time.

Preferably, the integrated circuit components of the combustion detecting and alarm generating portion of the detector are formed on the same substrate or chip, whereby the components complement each other by having their parameters vary in the same direction, so that the sensitivity of the detector to combustion remains substantially constant. Also, the integrated circuit components of the battery supervision portion of the detector are preferably formed on the same substrate, so that the components complement each other by having their parameters vary in the same direction. Ideally, both the combustion sensing and the battery supervision circuit are formed on the same chip, whereby all of the components have complementary parameters, and significant economies are realized both in the manufacture of the circuits and in the assembly of the circuits into the detector.

The invention thus provides an improved fire detector having integrated circuit components. As a consequence of the arrangement of the differential amplifier to monitor the voltage at the juncture of the active and the reference ionization chambers, regulation of the detector operating voltage across is not required, since any changes in operating voltage result in proportionately equal changes in voltage at the inputs of the differential amplifier. As a consequence of the battery supervision circuit, a user of the detector is warned of a decay in battery power to a predetermined level, and the test switch facilitates not only accurate adjustment of the sensitivity of the detector to combustion, but also enables a user of the detector to conveniently exercise all components of the combustion sensing and alarm generating circuit to ensure proper operation thereof in response to combustion. By virtue of the use of integrated circuits, the cost of fabricating the detector circuits, and the number of manually made connections between the circuit components and/or other portions of the detector, are minimized. As a result, not only is the reliability of the detector increased, but the cost of manufacturing is decreased, and the protection afforded by the detector is brought within the economic reach of a greater number of households than heretofore.

While one embodiment of the invention has been described in detail, various modifications and other embodiments thereof may be devised by one skilled in the art without departing from the spirit and the scope of the invention, as defined in the claims.

What is claimed is:

1. An improved warning device comprising means for detecting the presence of predetermined phenomena and for generating a first signal which changes to a predetermined value upon the presence of said phenomena in predetermined concentrations; indicator means having an active and an inactive state; integrated circuit means formed on a single substrate and connected with said detecting means and said indicator means and responsive to said detecting means to place said indicating means in said active state, said integrated circuit means including means for generating a reference potential, a differential amplifier including first and second field-effect transistors (FETs), said first FET connected at a gate electrode thereof directly with said detecting means for receiving said first signal, said second FET connected at a gate electrode thereof with said reference potential, said first FET connected with said second FET to control the conductivity between drain and source electrodes thereof in accordance with the value of said first signal, said drain-source circuit of said second FET providing a second signal, and second circuit means including a third FET connected at a gate electrode thereof with said drain-source circuit of said second FET for having the conductivity between drain and source electrodes thereof controlled by the conductivity of said second FET, and impedance means connected in series circuit with the drain-source circuit of said third FET for developing a third signal thereacross, said third signal having a value in accordance with the conductivity of said third FET; and switch means connected with said impedance means and said indicator means for having said third signal applied thereto, said switch means being responsive to said third signal to place said indicator means in said active state.

2. A warning device as set forth in claim 1, said switch means including a silicon controlled rectifier (SCR) having a gate connected with said impedance means for having said third signal applied thereto and an anode and a cathode in circuit with said indicator means, said SCR being rendered conductive by said third signal to place said indicator means in said active state upon said first signal having said predetermined value.

3. A warning device as set forth in claim 1, said device being battery powered and including integrated circuit battery self-supervision means on a single substrate, connected with said battery and with said indicator means for being powered by said battery and for monitoring the potential across said battery and for placing said indicator means in said active state upon said battery potential decreasing to a predetermined value.

4. A warning device as set forth in claim 3, said integrated circuit means and said integrated circuit battery supervision means being formed on the same substrate.

5. A warning device as set forth in claim 3, said integrated circuit battery supervision means including means for intermittently placing said indicator means in said active state upon said battery potential decreasing to said predetermined value.

6. A warning device as set forth in claim 3, said integrated circuit battery supervision means including means for establishing a first potential representative of said battery potential, means for establishing a predetermined and constant second reference potential, and means for monitoring said first potential and comparing said first potential with said second reference potential, said means for monitoring and comparing placing said indicator means in said active state when said first potential differs from said second reference potential by a predetermined amount.

7. An improved battery powered warning device comprising means for detecting the presence of a predetermined phenomenom, said detecting means having an output and providing thereat a first signal which changes in value upon the presence of said phenomenom; means for emitting a sensually perceptible signal, said emitting means having an active state in which said signal is emitted and an inactive state in which said signal is not emitted; means for generating a reference potential; integrated circuit means including differential amplifier means and control circuit means, said differential amplifier means including a first field-effect transistor (FET) connected at a gate electrode thereof with said detecting means output and a second FET connected at a gate electrode thereof with said reference potential, said first FET connected with said second FET to control the conductivity between drain and source electrodes thereof in accordance with the relative values of said first signal and said reference potential; first impedance means in series with said drain-source circuit of said second FET and having a voltage thereacross of a value in accordance with the conductivity of said second FET; said control circuit means including a third FET connected at a gate electrode thereof with said first impedance means, said voltage across said first impedance means controlling the conductivity between drain and source electrodes of said third FET, second impedance means in series with the drain-source circuit of said third FET and having a voltage thereacross of a value in accordance with the conductivity of said third FET, and switch means connected with said second impedance means and said emitting means for placing said emitting means in said active state in response to said voltage across said second impedance means upon said first signal changing in value upon the presence of said phenomenom.

8. An improved warning device as set forth in claim 7, said emitting means comprising an audible alarm, said switch means including a silicon controlled rectifier (SCR) having an anode and a cathode in series circuit with said audible alarm across said battery, said SCR having a gate electrode connected to sense said voltage across said second impedance means, said voltage across said second impedance means triggering said SCR into conduction to place said audible alarm in said active state in response to the presence of said phenomenom.

9. A warning device as set forth in claim 7, means for testing said warning device including manually manipulative means connected with said detecting means for changing the value of said first signal at said output therefrom in the absence of said phenomenom to at least a value as would occur upon the presence of said phenomenom.

10. An improved warning device as set forth in claim 7, second integrated circuit means for monitoring the output voltage of said battery and for periodically placing said emitting means in said active state when said voltage has a predetermined value.

11. In a warning device as set forth in claim 10, said first and said second integrated circuit means being formed on the same substrate.

12. An improved warning device means for applying an unregulated supply voltage to said device; means connected with said applying means for detecting the presence of predetermined phenomena, said detecting means having an output exhibiting an output voltage having a value in accordance with the value of said supply voltage in the absence of said phenomena and changing in value upon the presence of said phenomena; means connected with said applying means for generating a reference voltage having a value in accordance with the value of said supply voltage; means connected with said applying means for generating an indication, and differential amplifier means connected with said applying means and having a pair of inputs and an output, said output connected with said generating means, one of said inputs connected with said detecting means output voltage and the other of said inputs connected with said reference voltage, said differential amplifier means monitoring the difference in the values of said output and reference voltages and providing a signal at said output thereof to operate said generating means to generate said indication upon a predetermined difference in values between said voltages, said detecting means output and reference voltages simultaneously varying in value in accordance with changes in the value of said unregulated supply voltage whereby said difference in values therebetween remains substantially constant in the absence of said phenomena for varying values of said supply voltage so that said predetermined difference exists only upon the presence of said phenomena, said differential amplifier means including a first field-effect transistor (FET) connected at a gate electrode thereof with said detecting means output voltage and a second FET connected at a gate electrode thereof with said reference voltage, the drain-source circuits of said FETs being connected with said applying means for receiving the unregulated voltage and being interconnected so that said first FET controls the conductivity of said second FET between drain and source electrodes thereof in accordance with the difference in values of said output and reference voltages, said means for generating being connected with said drain-source circuit of said second FET and being responsive to the conductivity thereof between said electrodes to generate said indication, and including first impedance means in series circuit with said drain-source circuit of said second FET and having a voltage thereacross in accordance with the conductivity of said FET, said generating means including a third FET connected at a gate electrode thereof with said first impedance means, said voltage across said first impedance means controlling the conductivity between drain and source electrodes of said third FET, second impedance means in series circuit with the drain-source circuit of said third FET, said second impedance means and said drain-source circuit of said third FET connected with said means for applying, said second impedance means having a voltage thereacross in accordance with the conductivity of said third FET, said indicating means having an active and an inactive state, and switch means connected with said indicating means and said second impedance means, said switch means and said indicating means connected with said means for applying, said switch means responsive to said voltage across said second impedance means for placing said indicating means in said active state upon said detecting means output voltage changing in value upon the presence of said phenomena, whereby with all of said means for detecting, said means for generating a reference voltage, said means for generating an indication and said differential amplifier means being connected with said means for applying said unregulated supply voltage, said means for indicating is placed in said active state only upon said detecting means output changing in value upon the presence of said phenomena and irrespective of changes in value of said supply voltage.

* * * * *